US005361895A

United States Patent [19]

Wilson et al.

[11] Patent Number: 5,361,895

[45] Date of Patent: Nov. 8, 1994

[54] COMBINED VARIABLE VOLUME SHIPPING AND DISPLAY TRAY

[75] Inventors: William P. Wilson, Chappaqua, N.Y.; Beverly A. Bahnken, Stanhope, N.J.

[73] Assignee: WFR Ribbon, Inc., Phillipsburg, N.J.

[21] Appl. No.: 100,379

[22] Filed: Aug. 2, 1993

[51] Int. Cl.[5] ..... B65D 5/52

[52] U.S. Cl. ..... 206/44 R; 206/391; 206/557; 229/101; 229/193

[58] Field of Search ..... 229/101, 132, 193; 206/557, 44, 391

[56] References Cited

U.S. PATENT DOCUMENTS

| | | | |
|---|---|---|---|
| 1,230,552 | 6/1917 | Bain | 229/101 X |
| 2,037,839 | 4/1936 | Wagenseller | 229/101 |
| 2,331,551 | 10/1943 | Guyer | 229/101 X |
| 2,935,240 | 5/1960 | Belwood | 229/193 X |
| 2,988,259 | 6/1961 | Callinicos | 229/101 |
| 3,134,499 | 5/1964 | Johnson | 229/23 BT X |
| 3,180,555 | 4/1965 | Barrett | 229/101 |
| 5,249,550 | 10/1993 | Hines et al. | 229/101 X |

FOREIGN PATENT DOCUMENTS

| | | | |
|---|---|---|---|
| 1471597 | 3/1967 | France | 229/193 |

*Primary Examiner*—Bryon P. Gehman
*Attorney, Agent, or Firm*—James & Franklin

[57] ABSTRACT

A tray is provided for the shipping and display of a row of articles, the tray when configured for shipping being adapted to receive a particular number of such objects and when configured for display being adapted to receive a different number of such objects, the difference in configuration involving an end portion of the tray which is movable between a first position constituting an elongation of the main portion of the tray and a second position closing an end of that main portion.

4 Claims, 4 Drawing Sheets

COMBINED VARIABLE VOLUME SHIPPING AND DISPLAY TRAY

The present invention relates to a tray which can be used in one configuration for display of a number of objects and in another configuration for shipping of a different number of objects.

BACKGROUND OF THE INVENTION

The present invention is described in connection with the shipping and display of spools of ribbon, but its applicability is not limited to such use. Spools of ribbon are customarily displayed for selection and purchase on inclined shelves. Such a display usually involves ribbons different from one another in various respects, such as color, texture, material and the like. Ribbons of a given type are placed on the shelf in a row, with the spools of ribbon of different types being carried on the same shelf in adjacent rows. Usually the shelf is designed to receive a limited number of spools of ribbon in a given row. The purchaser will select the ribbon he wishes by removing from the shelf the lowermost spool of the type that he desires, and the remaining spools in that row will then roll down to the front of the inclined shelf, where a ledge or the like will retain the row on the shelf, ready for subsequent selection and removal of a ribbon spool.

It is desirable that the spools of a given type remain in the same row, but when a given row of spools becomes shortened because of the removal of spools therefrom by purchasers gaps are produced at the upper ends of those rows, and spools from adjacent rows may tend to move or fall over into those gaps, which is obviously undesirable.

In addition, the store where the ribbons are displayed is presented with the problem of maintaining a suitable inventory of spools of all desired types on display, but the store for obvious reasons does not wish to have an excessive inventory on hand so as to keep the ribbon display filled. For example, usually ribbons are displayed in rows of four, and the store does not reorder spools of a particular ribbon style until there is only one ribbon of that style left on the shelf. The store then orders three of such ribbons to fill up the shelf row corresponding to that particular type of ribbon.

BRIEF DESCRIPTION OF THE INVENTION

The present invention comprises a tray for receiving objects such as spools of ribbon which can function both as a tray for shipping those spools to a store and a tray adapted to be mounted on a display shelf so as to expose the ribbon spools for selection and purchase and to retain the spools in their proper rows. Moreover, the tray is specially designed to meet the needs of a business transaction where the number of spools shipped is a lesser number than the number of spools to be maintained in a given row on display. The tray here specifically disclosed is designed for the shipment of three ribbon spools and for modification after being received at the store to receive and display four ribbon spools in a row. As a result the store owner, when he receives the tray in shipping configuration containing three spools, can change the tray to its display configuration, insert into the tray the spool of the same type that the store had in stock so as to make up a row of four spools, and then that tray in its display configuration can be placed on the shelf, where it will keep all of the spools in a row and prevent them from falling down or entering an adjacent row.

This is accomplished by producing a tray from a single foldable blank, which tray has an end section foldably connected to its main section so as to be positionable in a first or display position in which it constitutes a longitudinal extension of the main section and a second or shipping position in which it extends upwardly from the main section, the main section in the embodiment here specifically disclosed having a length such as to receive three ribbon spools and the end section having a length such as to receive a single ribbon spool. Hence when the end section is in its second position it in effect closes one end of the tray, which can then be used for shipping three ribbon spools, and when the end section is in its first position the tray will receive four ribbon spools and can be placed on the inclined display shelf in the store with those four spools retained in a row and ready to be selected and removed by a customer.

It is therefore the prime object of the present invention to devise a tray which can be used optionally for both shipping and display purposes and which can accommodate different numbers of objects to be displayed when configured for shipping and display purposes respectively. Ordinarily, as has been explained above, the tray in its display configuration will hold a greater number of objects than when in its shipping configuration, but it will be understood that that is not essential to the instant invention.

It is a further object of the present invention to devise such a display-purpose tray which can be conveniently and inexpensively made from a single blank adapted to be folded into its various operative positions.

BRIEF DESCRIPTION OF THE DRAWINGS

To the accomplishment of the above, and to such other objects as may hereinafter appear, the present invention relates to the construction of a tray having the above-described characteristics as defined in the appended claims and as described in this specification, taken together with the accompanying drawings, in which

DETAILED DESCRIPTION

While the present invention is here specifically disclosed in connection with the shipping, display and sale of spools of ribbon and to accommodate business conditions normally associated with such products, this is by way of exemplification only, and the teachings of the present invention can readily be adapted to other specific applications.

Ribbons come in many different sizes, styles and colors and a prospective purchaser is usually looking for ribbon only of a particular type. A store selling such ribbons must therefore display many different types of ribbons so as to satisfy the predilections of each customer. Accordingly, the store will usually display the ribbons that it has for sale on a rack comprising a plurality of superposed shelves 2 mounted in such a fashion as to be inclined to the horizontal, with the lower shelf end 2*a* having a lip 4, and the ribbon spools, generally designated A, which have circular walls 6 at their ends, are mounted on the shelf 2 in rows, the spools A tending to roll down toward the lower shelf end 2*a* until the forwardmost spool A comes in contact with the lip 4. In the ribbon business it is customary for the shelf 2 to be of a length such as to accommodate four spools A in each row. When the display is full, therefore, each shelf 2 will be holding and displaying a large number of rows of ribbon spools with four spools in each row, and usually the spools in a given row will be of the same type. As ribbon spools are selected and removed by customers, the number of spools in a given row decreases, and ordinarily when the store owner sees that there is only one spool of a given type left in a given row he will reorder three spools of that type from the manufacturer. Hence the manufacturer usually will be shipping spools of a given type in batches of three.

Figure 3:
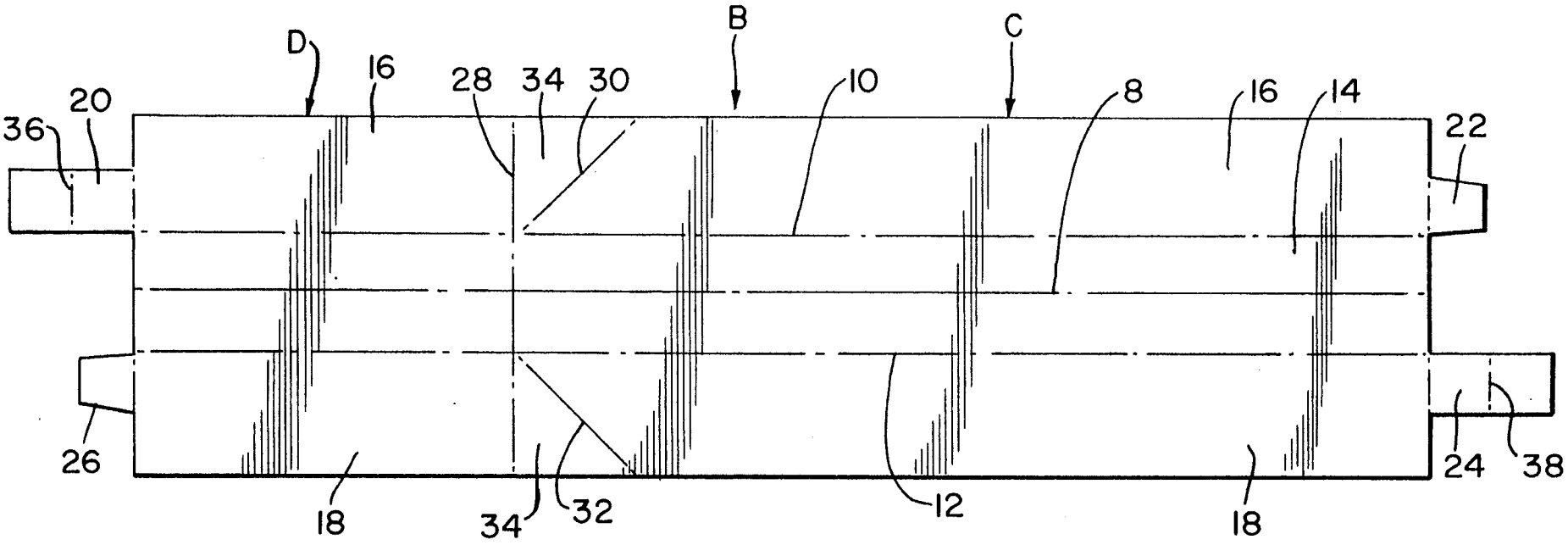
FIG. 3 is a top plan view of the blank from which the tray of the present invention can be formed.

It is to accommodate this situation that the instant tray, generally designated B, has been devised. That tray B is preferably formed from a single blank of suitable material such as paperboard shown in FIG. 3, that blank comprising a main section generally designated C and an end section generally designated D. The blank is essentially rectangular in shape, it is provided with a central fold line 8 extending from one end to the other which is flanked by fold lines 10 and 12 also extending longitudinally of the blank, thereby to divide the blank into a bottom wall panel 14 located between the fold lines 10 and 12 and preferably bisected by the fold line 8, and side wall panels 16 and 18 extending from the fold lines 10 and 12 respectively to the sides of the blank. Tabs 20, 22, 24 and 26 extend longitudinally from the ends of the side wall panels 16 and 18 close to the fold lines 10 and 12. The dividing line between the main section C and the end section D is defined by a fold line 28 extending from one side of the blank to the other, and inclined fold lines 30 and 32 extend respectively from the junctions of the fold line 28 with the fold lines 10 and 12 to the sides of the blank, thereby along with the fold line 28 defining triangular panels 34. The tabs 20 and 24 extending from opposite ends of the blank are longer than the tabs 26 and 22 also extending from that end respectively. The tab 20 is provided with fold line 36 and the tab 24 is provided with fold line 38. In this specific embodiment the length of the main section C corresponds to the combined length of three ribbon spools A while the length of the end section D corresponds to the length of a single ribbon spool A.

The blank is initially set up by folding it along its central fold line 8 and adhesively securing the extending tips of the tabs 20 and 24 to the corresponding shorter tabs 26 and 22 respectively, the longer tabs then folding along the fold lines 36 and 38 respectively. The blanks may be stored in this condition, ready for use.

Figure 4:
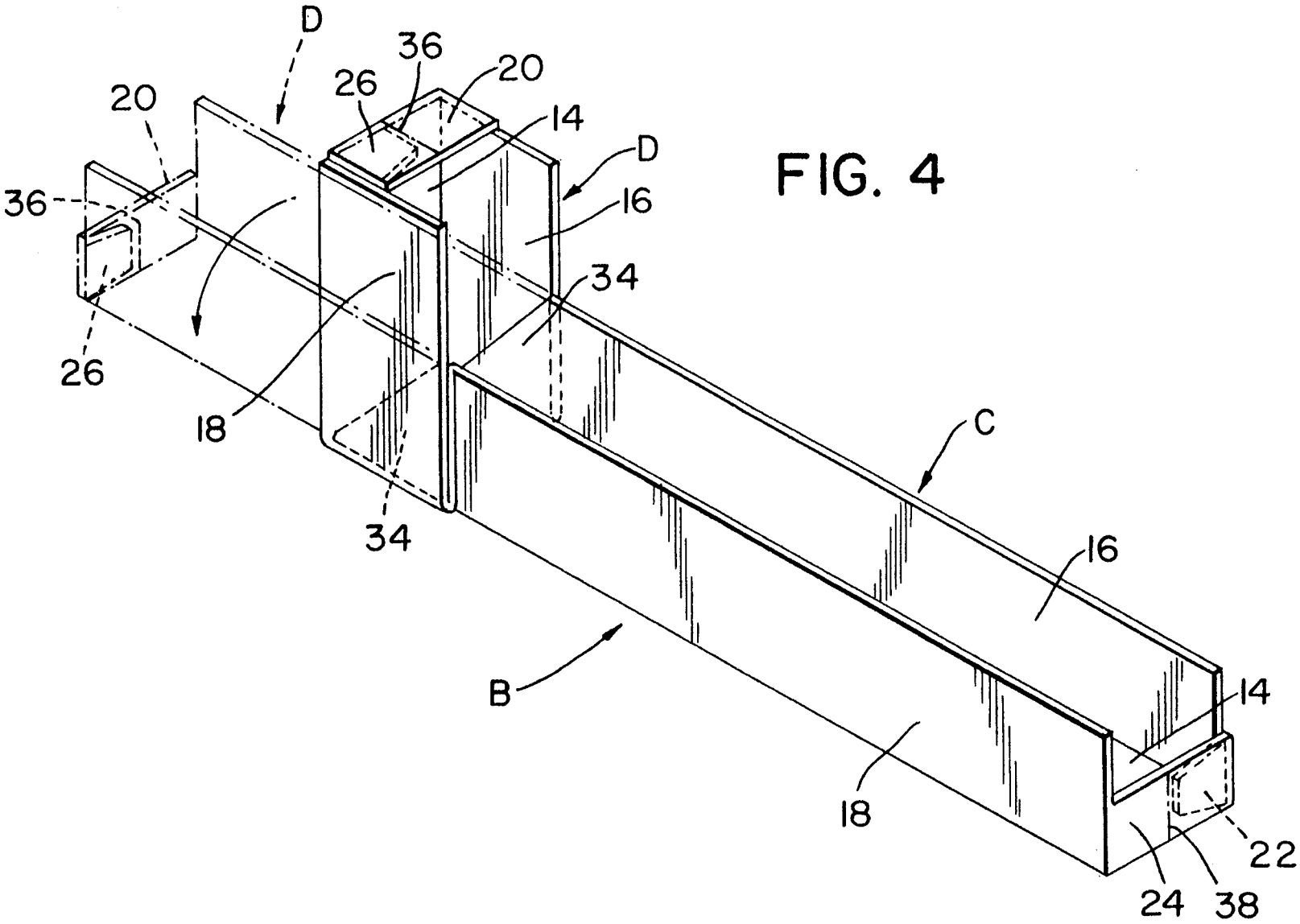
FIG. 4 is a three-quarter perspective view of the erected tray of the present invention, shown in solid lines in its shipping configuration and in phantom lines in its display configuration.

When the manufacturer receives an order for three ribbon spools of a particular type he will erect the blank by unfolding the bottom wall panel 14 along the fold line 8 and lifting up the end section D to a vertical position, as shown in solid lines in FIG. 4. When this is done the blank will fold about the fold lines 28, 30 and 32 with those portions of the fold line 28 in the side wall panels 16 and 18 resting on the bottom wall panel 14 and with the triangular panels 34 lying inside and along the side wall panels 16 and 18. One end of the thus formed tray will be closed by the flaps 22 and 24, the other end will be closed by the upright end section D, the tray will snugly receive the three spools A of ribbon that have been ordered, and the tray can then be shipped to the store with those three spools A in it.

Figure 1:
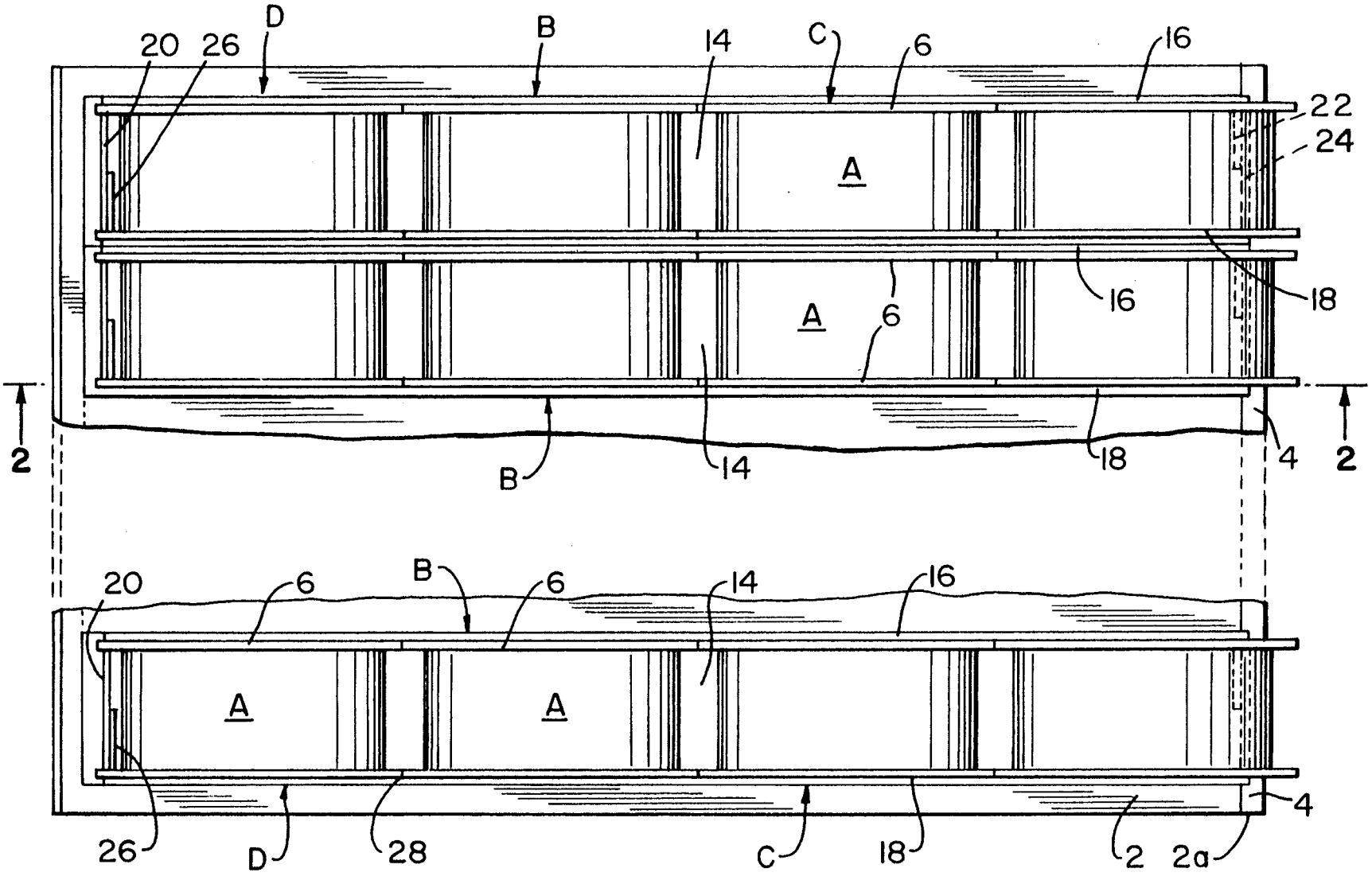
FIG. 1 is a top plan view of a display shelf with a plurality of trays of the present invention thereon, the trays containing spools of ribbon.
Figure 2:
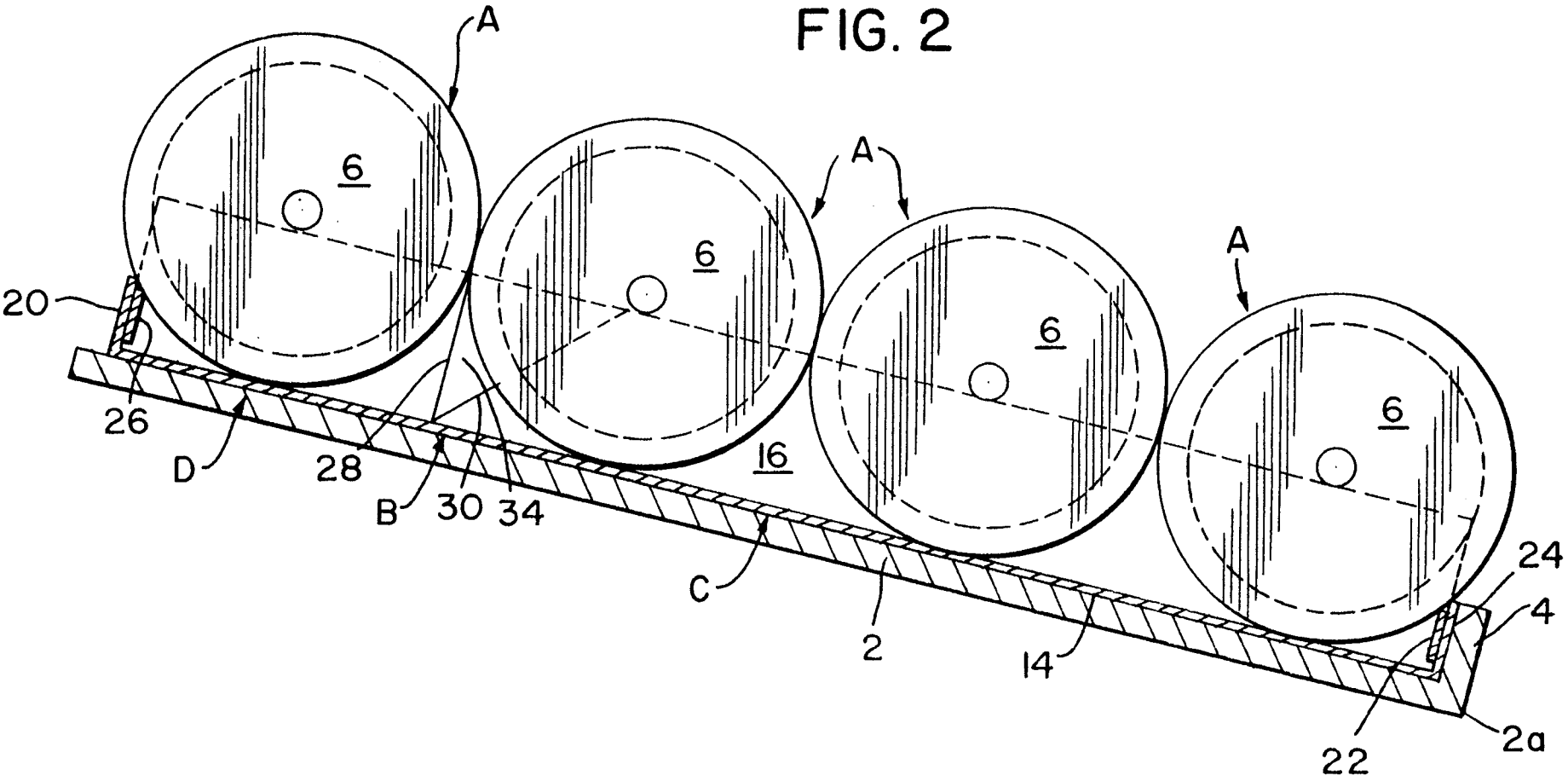
FIG. 2 is a cross-sectional view taken along the line 2—2 of FIG. 1.

When the tray with its three spools arrives at the store the store will in all likelihood have on its shelf 2 another spool A of the same type, since the store owner will have ordered replacement spools before he was completely out of spools of that type. The store owner will then take the tray and, as indicated by the phantom lines in FIG. 2, fold the then upright end section D down to constitute an elongation of the main section C of the tray, that elongation being closed at its end by the tabs 20 and 26. The store owner will take the one spool that he has in stock and place it in the now extended tray to there join the three spools that were initially shipped in that tray, and he will place the tray with those four spools in it on the shelf 2, removing, if necessary, a previously shipped tray. The tray when mounted on the shelf 2, as shown in FIGS. 1 and 2, will retain its spools A in a row whatever may be the status of the next adjacent row, thus ensuring proper and effective display at all times.

Hence from a single readily fabricated foldable blank there is produced a tray adaptable to contain different numbers of objects. In particular the tray here disclosed is specially adapted to the shipment of a particular number, usually three, of spools of ribbon and to the display of a greater number, usually four, of such spools, thus conforming to the conventional requirements of the ribbon business, but it will be apparent that the invention is adaptable to many other applications as to type of product and numbers of items accommodated, all within the spirit of the invention as defined in the following claims.

We claim:

1. In combination, a plurality of items having a given length and width and a combined shipping and display tray for said items, said tray having a bottom wall of a width corresponding to the width of said items and a length many times greater than said width and corresponding to the combined lengths of a given plurality of said items said tray, having side walls extending up from said bottom wall along substantially the entire length thereof, said tray having a top open over substantially its entire length and width, and said tray having end walls substantially closing the ends of said tray, an end portion of said bottom wall comprising an end section foldably connected to the remainder of said bottom wall and having a length which is only a minor fraction of the length of said bottom wall and corresponding to the length of a number of said items which is less than said given plurality, said end section being foldable between a first position in which it constitutes an extension of said remainder of said bottom wall, said tray then being adapted to receive said given plurality of said items, and a second position in which it extends up from said remainder of said bottom wall, said tray then being adapted to receive and hold for shipping a number of said items less than said given plurality.

2. The combination of claim 1, in which the end wall at said end portion has a height substantially less than the length of said end section.

3. The combination of claim 1, in which said end section has a length corresponding to the length of a single one of said items.

4. The combination of any of claims 1–3, in which said items are ribbon spools having a thickness much less than their diameter, said bottom wall having a width many times less than its length, which width corresponds to the thickness of said items.

* * * * *